US007063174B2

(12) United States Patent
Chemali et al.

(10) Patent No.: US 7,063,174 B2
(45) Date of Patent: Jun. 20, 2006

(54) METHOD FOR RESERVOIR NAVIGATION USING FORMATION PRESSURE TESTING MEASUREMENT WHILE DRILLING

(75) Inventors: Roland E. Chemali, Kingwood, TX (US); Tron B. Helgesen, Stavanger (NO); Volker Krueger, Celle (DE); Matthias Meister, Celle (DE); Per-Erik Berger, Vestre Amoy (NO); Peter Aronstam, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 260 days.

(21) Appl. No.: 10/701,757

(22) Filed: Nov. 5, 2003

(65) Prior Publication Data

US 2004/0245016 A1 Dec. 9, 2004

Related U.S. Application Data

(60) Provisional application No. 60/425,452, filed on Nov. 12, 2002.

(51) Int. Cl.
*E21B 47/06* (2006.01)

(52) U.S. Cl. ..... 175/48

(58) Field of Classification Search ..... None
See application file for complete search history.

(56) References Cited

U.S. PATENT DOCUMENTS

| | | | | |
|---|---|---|---|---|
| RE35,386 | E | 12/1996 | Wu et al. | 175/45 |
| 6,308,136 | B1 | 10/2001 | Tabarovsky et al. | 702/7 |
| 6,427,530 | B1 * | 8/2002 | Krueger et al. | 73/152.46 |
| 6,464,021 | B1 | 10/2002 | Edwards | 175/61 |

* cited by examiner

*Primary Examiner*—Zakiya W. Bates
(74) *Attorney, Agent, or Firm*—Madan, Mossman & Sriram, P.C.

(57) ABSTRACT

A formation pressure testing while drilling device on a bottomhole assembly makes measurements of fluid pressure during drilling of a borehole. Based on the pressure measurements, drilling direction can be altered to maintain the wellbore in a desired relation to a fluid contact. Acoustic transmitters and/or receivers on the bottomhole assembly can provide additional information about bed boundaries, faults and gas-water contacts.

32 Claims, 5 Drawing Sheets

METHOD FOR RESERVOIR NAVIGATION USING FORMATION PRESSURE TESTING MEASUREMENT WHILE DRILLING

CROSS REFERENCES TO RELATED APPLICATIONS

This application claims priority from U.S. Provisional Patent Application Ser. No. 60/425,452 filed on Nov. 12, 2002

BACKGROUND OF THE INVENTION

1. Field of the Invention

This invention relates generally to drilling of lateral wells into an hydrocarbon reservoir, and more particularly to the maintaining the wells in a desired position relative to fluid contacts within the reservoir and relative to each other.

2. Description of the Related Art

To obtain hydrocarbons such as oil and gas, well boreholes are drilled by rotating a drill bit attached at a drill string end. The drill string may be a jointed rotatable pipe or a coiled tube. Boreholes may be drilled vertically, but directional drilling systems are often used for drilling boreholes deviated from vertical and/or horizontal boreholes to increase the hydrocarbon production. Modern directional drilling systems generally employ a drill string having a bottomhole assembly (BHA) and a drill bit at an end thereof that is rotated by a drill motor (mud motor) and/or the drill string. A number of downhole devices placed in close proximity to the drill bit measure certain downhole operating parameters associated with the drill string. Such devices typically include sensors for measuring downhole temperature and pressure, tool azimuth, tool inclination. Also used are measuring devices such as a resistivity-measuring device to determine the presence of hydrocarbons and water. Additional downhole instruments, known as measurement-while-drilling (MWD) or logging-while-drilling (LWD) tools, are frequently attached to the drill string to determine formation geology and formation fluid conditions during the drilling operations.

Boreholes are usually drilled along predetermined paths and proceed through various formations. A drilling operator typically controls the surface-controlled drilling parameters during drilling operations. These parameters include weight on bit, drilling fluid flow through the drill pipe, drill string rotational speed (r.p.m. of the surface motor coupled to the drill pipe) and the density and viscosity of the drilling fluid. The downhole operating conditions continually change and the operator must react to such changes and adjust the surface-controlled parameters to properly control the drilling operations. For drilling a borehole in a virgin region, the operator typically relies on seismic survey plots, which provide a macro picture of the subsurface formations and a pre-planned borehole path. For drilling multiple boreholes in the same formation, the operator may also have information about the previously drilled boreholes in the same formation.

In development of reservoirs, it is common to drill boreholes at a specified distance from fluid contacts within the reservoir. An example of this is shown in FIG. 1 where a porous formation denoted by 5*a*, 5*b* has an oil water contact denoted by 13. The porous formation is typically capped by a caprock such as 3 that is impermeable and may further have a non-porous interval denoted by 9 underneath. The oil-water contact is denoted by 13 with oil above the contact and water below the contact: this relative positioning occurs due to the fact the oil has a lower density than water. In reality, there may not be a sharp demarcation defining the oil-water contact; instead, there may be a transition zone with a change from high oil saturation at the top to a high water saturation at the bottom. In other situations, it may be desirable to maintain a desired spacing from a gas-oil. This is depicted by 14 in FIG. 1. It should also be noted that a boundary such as 14 could, in other situations, be a gas-water contact.

In order to maximize the amount of recovered oil from such a borehole, the boreholes are commonly drilled in a substantially horizontal orientation in close proximity to the oil water contact, but still within the oil zone. US Patent RE35386 to Wu et al, having the same assignee as the present application and the contents of which are fully incorporated herein by reference, teaches a method for detecting and sensing boundaries in a formation during directional drilling so that the drilling operation can be adjusted to maintain the drillstring within a selected stratum is presented. The method comprises the initial drilling of an offset well from which resistivity of the formation with depth is determined. This resistivity information is then modeled to provide a modeled log indicative of the response of a resistivity tool within a selected stratum in a substantially horizontal direction. A directional (e.g., horizontal) well is thereafter drilled wherein resistivity is logged in real time and compared to that of the modeled horizontal resistivity to determine the location of the drill string and thereby the borehole in the substantially horizontal stratum. From this, the direction of drilling can be corrected or adjusted so that the borehole is maintained within the desired stratum. The configuration used in the Wu patent is schematically denoted in FIG. 1 by a borehole 15 having a drilling assembly 21 with a drill bit 17 for drilling the borehole. The resistivity sensor is denoted by 19 and typically comprises a transmitter and a plurality of sensors. Measurements may be made with propagation sensors that operate in the 400 kHz and higher frequency.

A limitation of the method and apparatus used by Wu is that resistivity sensors are responsive to oil/water contacts for relatively small distances, typically no more than 5 m; at larger distances, conventional propagation tools are not responsive to the resistivity contrast between water and oil. One solution that can be used in such a case is to use an induction logging that typically operate in frequencies between 10 kHz and 50 kHz. U.S. Pat. No. 6,308,136 to Tabarovsky et al having the same assignee as the present application and the contents of which are fully incorporated herein by reference, teaches a method of interpretation of induction logs in near horizontal boreholes and determining distances to boundaries in proximity to the borehole.

A second situation encountered in reservoir development is illustrated in FIG. 2. Denoted is a borehole 15' drilled by a drillbit 17' on a drilling assembly 21'. The reservoir is denoted by 51 and includes a gas-oil contact 57. The objective in drilling here is maintain the borehole at a well below the gas-oil contact. Due to the fact that both gas and oil have relatively high resistivity, it is not possible to ascertain the location of the gas-oil contact using resistivity methods.

U.S. Pat. No. 6,464,021 to Edwards discloses a method for Geosteering using pressure measurements. The method relies upon the fact that vertical fluid pressure gradient (FPG) in a virgin formation depend primarily on the density of the fluid in the formation. Specifically, the vertical FPG in water is approximately 0.5 psi/ft (11.3 kPA/m) for a density of 1.09 g/cc; in oil of density 0.65 g/cc the FPG is 0.37 psi/ft (8.4 kPa/m) while in gas of density 0.18 g/cc the FPG is 0.08 psi/ft (1.81 kPA/m). The method of Edwards includes deploying a number of remote sensing units including pressure sensors into the formation. The deployment is done either from a drill string tool or from an open hole logging tool by drilling into the formation, punching or pressing the remote sensing unit into the formation, or shooting the remote sensing unit into the formation. Using the deployed units, a determination is made of the depth at which drilling of a deviated borehole is to commence. In the absence of hydrodynamic flow, the fluid interface will be substantially horizontal However, there is no discussion in Edwards of a method for maintaining the borehole at the desired depth. All of these are complicated procedures and involve multiple trips down the borehole and/or carrying a number of remote sensing units into the borehole. Another problem not fully addressed in prior art is the spacing of wells for reservoir development.

As a specific example, the desired spacing may be 200 m or so. When surveying is carried out using a gyroscope on a wireline device or a slickline device, a typical accuracy is 1°, which translates into a deviation of 17 m for a 1000 m borehole or 170 m for a 10 km horizontal borehole. With errors of this magnitude, it is difficult to maintain a desired horizontal spacing of 200 m between boreholes. The result is that the reservoir may be oversampledi with boreholes, which costs time and money, or the reservoir may be underampled, resulting in portions of the reservoir being undrained.

It would be desirable to have a method of controlling the drilling of a borehole in a reservoir and maintaining the borehole at a defined distance relative to a fluid interface such as a gas/oil interface or an oil/water interface. Such a method should preferably also be able to maintain the borehole at a specified horizontal spacing relative to a pre-existing borehole. Such a method should reduce the number of interruptions of drilling for the purposes of taking measurements to a minimum. Such a method should also be relatively simple and easy to deploy. The present invention satisfies these needs.

SUMMARY OF THE INVENTION

The present invention is a method and apparatus for developing a hydrocarbon reservoir in an earth formation. A bottom hole assembly (BHA) is used for drilling a borehole. The BHA including a formation pressure tester while drilling (FPTWD) for determining a pressure of a fluid in said earth formation. The formation fluid pressure is intermittently monitored using the FPTWD. The borehole is drilled to a first depth wherein a measured value of said fluid pressure is substantially equal to a predetermined value. The fluid pressure is monitored during continued drilling operations and the drilling direction is altered if a measurement of said fluid pressure differs from the predetermined value.

In a preferred embodiment of the invention, the FPTWD obtains small samples of the reservoir fluid. The predetermined value of fluid pressure preferably corresponds to one of: (i) a specified depth above an oil-water contact, and, (ii) a specified depth below a gas-water contact.

In one embodiment of the invention, the predetermined value of said fluid pressure is obtained from a vertical borehole in said earth formation. Alternatively, a resistivity device such as an induction tool or a propagation resistivity tool is used to drill to a depth close to a detectable oil-water contact and the pressure at that depth is used as a basis for the predetermined value. In the case of a gas-oil or gas-water contact, an acoustic device may be used for defining the depth at which a predetermined pressure is specified. When an acoustic device is used on the BHA, a look-ahead capability may be used to define, in addition to bed boundaries, faults and hard streaks such as those caused by calcite or intrusives.

Optionally, an azimuthal density, porosity or resistivity imaging tool may be used to avoid material such as shale lenses in the reservoir.

In one embodiment of the invention, in addition to maintaining a desired position relative to a fluid interface in the reservoir, a desired spacing of a wellbore relative to a preexisting wellbore is maintained. This is accomplished by one of several methods. In one method, acoustic waves generated by either the drill bit or by an acoustic transmitter on the BHA are detected at a plurality of acoustic receivers at known locations in a preexisting wellbore. Analysis of the received acoustic waves makes it possible to determine the position of the acoustic source (drill bit or transmitter) relative to the preexisting borehole.

Alternatively, the position of the borehole relative to one or more preexisting boreholes can be determined by producing pressure pulses in the preexisting borehole(s) and determining a traveltime for the pulses to be detected by the FPTWD. In another embodiment of the invention, pressure pulses from preexisting boreholes are used for maintaining a desired wellbore spacing.

BRIEF DESCRIPTION OF THE DRAWINGS

For detailed understanding of the present invention, reference should be made to the following detailed description of the preferred embodiment, taken is conjunction with the accompanying drawings, in which like elements have been given like numerals and wherein.

DESCRIPTION OF THE PREFERRED EMBODIMENTS

Figure 3:
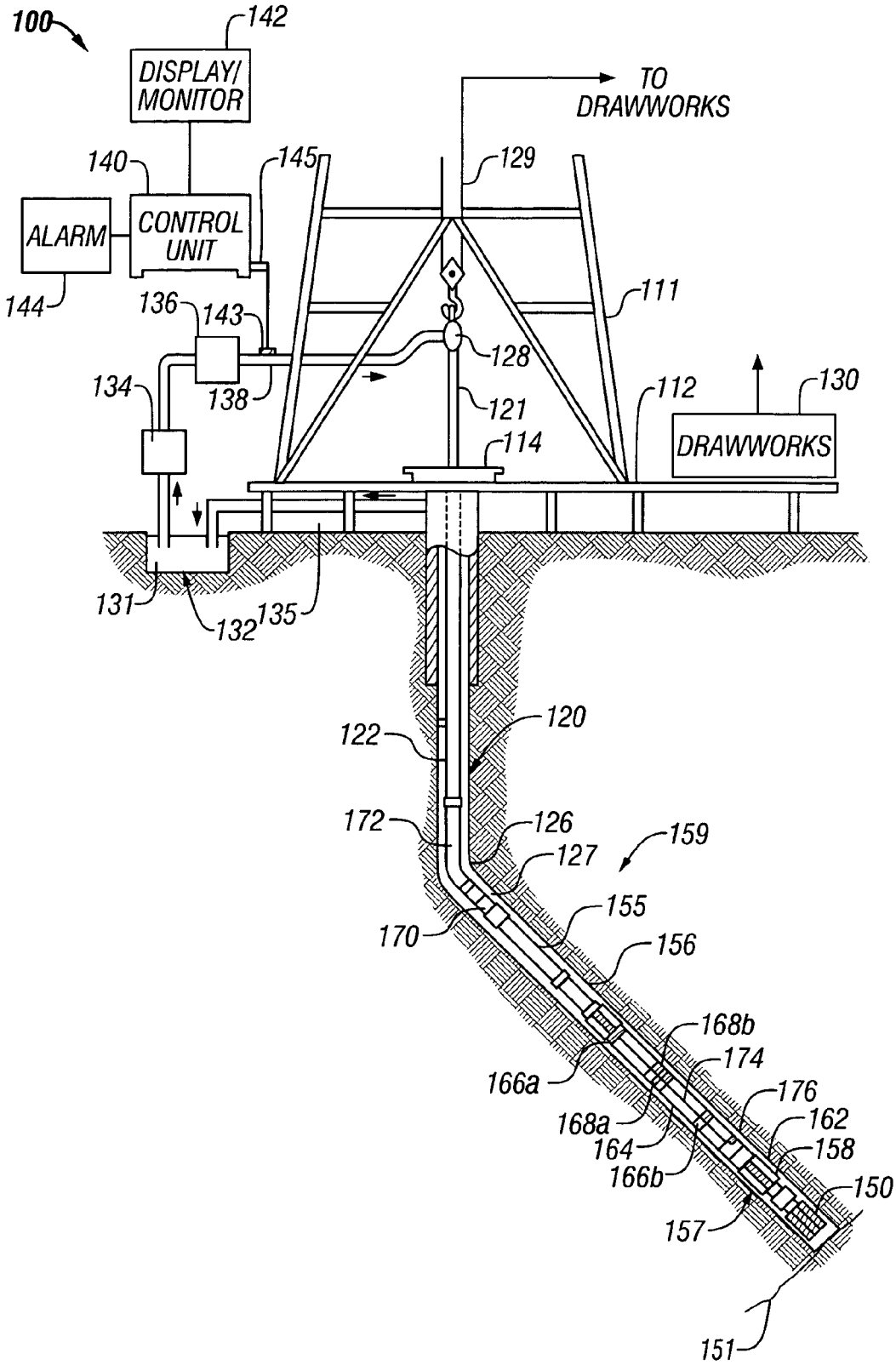
FIG. 3 shows a schematic diagram of a drilling system having a drill string that includes a sensor system according to the present invention.

FIG. 3 shows a schematic diagram of a drilling system 110 having a downhole assembly containing an acoustic sensor system and the surface devices according to one embodiment of present invention. As shown, the system 110 includes a conventional derrick 111 erected on a derrick floor 112 which supports a rotary table 114 that is rotated by a prime mover (not shown) at a desired rotational speed. A drill string 120 that includes a drill pipe section 122 extends downward from the rotary table 114 into a borehole 126. A drill bit 150 attached to the drill string downhole end disintegrates the geological formations when it is rotated. The drill string 120 is coupled to a drawworks 130 via a kelly joint 121, swivel 118 and line 129 through a system of pulleys 127. During the drilling operations, the drawworks 130 is operated to control the weight on bit and the rate of penetration of the drill string 120 into the borehole 126. The operation of the drawworks is well known in the art and is thus not described in detail herein.

During drilling operations a suitable drilling fluid (commonly referred to in the art as "mud") 131 from a mud pit 132 is circulated under pressure through the drill string 120 by a mud pump 134. The drilling fluid 131 passes from the mud pump 134 into the drill string 120 via a desurger 136, fluid line 138 and the kelly joint 121. The drilling fluid is discharged at the borehole bottom 151 through an opening in the drill bit 150. The drilling fluid circulates uphole through the annular space 127 between the drill string 120 and the borehole 126 and is discharged into the mud pit 132 via a return line 135. Preferably, a variety of sensors (not shown) are appropriately deployed on the surface according to known methods in the art to provide information about various drilling-related parameters, such as fluid flow rate, weight on bit, hook load, etc.

A surface control unit 140 receives signals from the downhole sensors and devices via a sensor 143 placed in the fluid line 138 and processes such signals according to programmed instructions provided to the surface control unit. The surface control unit displays desired drilling parameters and other information on a display/monitor 142 which information is utilized by an operator to control the drilling operations. The surface control unit 140 contains a computer, memory for storing data, data recorder and other peripherals. The surface control unit 140 also includes models and processes data according to programmed instructions and responds to user commands entered through a suitable means, such as a keyboard. The control unit 140 is preferably adapted to activate alarms 144 when certain unsafe or undesirable operating conditions occur.

A drill motor or mud motor 155 coupled to the drill bit 150 via a drive shaft (not shown) disposed in a bearing assembly 157 rotates the drill bit 150 when the drilling fluid 131 is passed through the mud motor 155 under pressure. The bearing assembly 157 supports the radial and axial forces of the drill bit, the downthrust of the drill motor and the reactive upward loading from the applied weight on bit. A stabilizer 158 coupled to the bearing assembly 157 acts as a centralizer for the lowermost portion of the mud motor assembly. The use of a motor is for illustrative purposes and is not a limitation to the scope of the invention.

In one embodiment of the system of present invention, the downhole subassembly 159 (also referred to as the bottomhole assembly or "BHA") which contains the various sensors and MWD devices to provide information about the formation and downhole drilling parameters and the mud motor, is coupled between the drill bit 150 and the drill pipe 122. The downhole assembly 159 preferably is modular in construction, in that the various devices are interconnected sections so that the individual sections may be replaced when desired.

Still referring back to FIG. 3, the BHA also preferably contains sensors and devices in addition to the above-described sensors. Such devices include a device for measuring the formation resistivity near and/or in front of the drill bit, a gamma ray device for measuring the formation gamma ray intensity and devices for determining the inclination and azimuth of the drill string. The formation resistivity measuring device 164 is preferably coupled above the lower kick-off subassembly 162 that provides signals, from which resistivity of the formation near the drill bit 150 is determined. A multiple propagation resistivity device ("MPR") having one or more pairs of transmitting antennae 166*a* and 166*b* spaced from one or more pairs of receiving antennae 168*a* and 168*b* is used. Magnetic dipoles are employed which operate in the medium frequency and lower high frequency spectrum. In operation, the transmitted electromagnetic waves are perturbed as they propagate through the formation surrounding the resistivity device 164. The receiving antennae 168*a* and 168*b* detect the perturbed waves. Formation resistivity is derived from the phase and amplitude of the detected signals. The detected signals are processed by a downhole circuit or processor that is preferably placed in a housing 170 above the mud motor 155 and transmitted to the surface control unit 140 using a suitable telemetry system 172. In addition to or instead of the propagation resistivity device, a suitable induction logging device may be used to measure formation resistivity.

The inclinometer 174 and gamma ray device 176 are suitably placed along the resistivity measuring device 164 for respectively determining the inclination of the portion of the drill string near the drill bit 150 and the formation gamma ray intensity. Any suitable inclinometer and gamma ray device, however, may be utilized for the purposes of this invention. In addition, an azimuth device (not shown), such as a magnetometer or a gyroscopic device, may be utilized to determine the drill string azimuth. Such devices are known in the art and are, thus, not described in detail herein. In the above-described configuration, the mud motor 155 transfers power to the drill bit 150 via one or more hollow shafts that run through the resistivity measuring device 164. The hollow shaft enables the drilling fluid to pass from the mud motor 155 to the drill bit 150. In an alternate embodiment of the drill string 120, the mud motor 155 may be coupled below resistivity measuring device 164 or at any other suitable place.

The drill string contains a modular sensor assembly, a motor assembly and kick-off subs. In a preferred embodiment, the sensor assembly includes a resistivity device, gamma ray device and inclinometer, all of which are in a common housing between the drill bit and the mud motor. The downhole assembly of the present invention preferably includes a MWD section 168 which contains a nuclear formation porosity measuring device, a nuclear density device, an acoustic sensor system placed, and a formation testing system above the mud motor 164 in the housing 178 for providing information useful for evaluating and testing subsurface formations along borehole 126. A downhole processor may be used for processing the data.

The formation testing apparatus comprises an apparatus such as that disclosed in U.S. Pat. No. 6,157,893 to Berger et al, having the same assignee as the present invention and the contents of which are fully incorporated herein by reference. One feature of the formation testing apparatus of Berger is that the testing apparatus is mounted on a non-rotating sleeve. This makes it possible to obtain samples of and measure properties of the formation fluid and measure. With a non-rotating sleeve, it is possible to obtain fluid samples during continued rotation of the drillbit ("making hole"). However, this is not essential. It is possible make measurements with a formation pressure tester that is not on a non-rotating sleeve while not making hole, e.g., during pauses in drilling, pauses while sliding into or tripping out of the borehole. For this reason, the term "while drilling" when used in the present application is intended to cover making hole, making measurements during pauses in drilling, sliding, or tripping. One specific property of the formation fluid that are of interest in the present invention are the pressure of the formation fluid. Details of the formation testing apparatus are given in Berger et al. For convenience, this device or a similar device is referred to hereafter as a formation pressure testing while drilling (FPT-WD) device.

An alternative FPT-WD better suited for the present invention is disclosed in U.S. Pat. No. 6,478,096 to Jones et al. having the same assignee as the present application. One embodiment of the Jones device includes an extendable pad member for isolating a portion of the formation wall and a port for withdrawing formation fluid. A particular advantage of the Jones device is that it comprises an incremental drawdown system that significantly reduces the overall measurement time, thereby increasing drilling efficiency and safety.

In an optional embodiment of the present invention, the acoustic measuring system preferably includes a system such as that disclosed in U.S. Pat. No. 6,084,826 to Leggett et al, having the same assignee as the present invention and the contents of which are fully incorporated herein by reference. As discussed in Leggett et al, the acoustic system includes the ability to measure acoustic velocities of the formation as well as a distance to a reflecting boundary. Both of these features are relevant to one embodiment of the present invention.

One feature of the device disclosed by Leggett is the incorporation of multiple segmented transmitters and receivers. With the use of multiple segmented transmitters and receivers, it is possible to direct acoustic energy in any selected direction and receive acoustic energy from any selected direction.

Using various combinations of the sensors available, the present invention makes it possible to achieve a number of difference objectives. These are discussed in turn.

Objective 1: Reservoir Navigation 2–5 M above Oil-Water Contact

There are two preferred methods of achieving this objective. One method relies on the methodology described in the Wu patent discussed above. A pilot hole is first drilled into the reservoir. The pilot hole is preferably a vertical or near vertical borehole in which resistivity measurements are made with either a MWD device or a wireline or slickline device. Next, it is desired to drill a deviated borehole at a selected depth proximate to the oil-water contact identified in the pilot well. Using the method described by Wu, the second hole includes a resistivity measuring device that makes measurements of resistivity as the borehole is being drilled. Based on the pilot hole measurements, modeling results may be generated for a desired trajectory of the deviated borehole and corrective action is taken to alter the drilling direction based on the MWD resistivity measurements. This method is described adequately in Wu and is not discussed further here. Propagation resistivity measurements may be used for the purpose. It is also to be noted that methods discussed below with reference to OBJECTIVE 2 may also be used.

Objective 2: Reservoir Navigation 6–15 M above Oil-Water Contact

This can be accomplished using the same principles as OBJECTIVE 1. However, to do this, a deeper reading resistivity propagation tool is needed. Alternatively, an induction logging tool may be used and the data interpreted using the method described in Tabarovsky. In the method of Tabarovsky, an induction logging tool is used in an inclined borehole for determining properties of subsurface formations formation away from the borehole. Measurements are made at a plurality of transmitter-receiver (T-R) distances. After correction of the data for skin effects and optionally correcting for eddy currents within the borehole, the shallow measurements (those from short T-R spacing or from high frequency data) are inverted to give a model of the near borehole (invaded zone resistivity and diameter) and the resistivity of the formation outside the invaded zone. Using this model, a prediction is made of the data measured by the mid-level and deep sensors (long T-R spacings). A discrepancy between these predicted values and the actual measurements made by the midlevel and deep sensors is indicative of additional layer boundaries in the proximity of the borehole. One such additional boundary would be the oil-water interface. Based on measurements made with an induction logging tool, the drilling direction is controlled so as to maintain a desired value of resistivity measurements made thereby. It is to be noted that when the method of Tabarovsky is used with a MWD device, skin effect corrections may no be necessary and the induction measurements may be inverted directly to establish a distance to the oil-water contact. Such a deep reading resistivity tool would require relatively long transmitter-receiver distances and would also likely have to operate at relatively low frequencies (~20 kHz) where the noise levels would be high. Power requirements would also be high.

Figure 4:
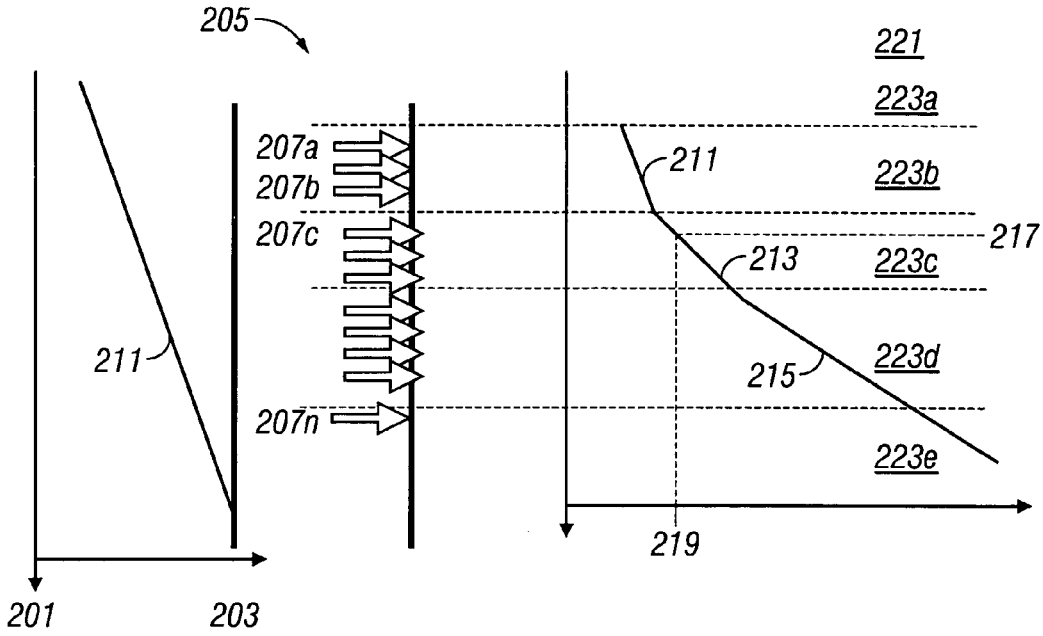
FIG. 4 illustrates differences between vertical fluid pressure gradients in different types of formation fluids and in a borehole.

An alternate method in the present invention relies on the use of pressure measurements made with a device such as that of Berger et al or Jones et al. The principle behind the method is illustrated in FIG. 4.

Depicted schematically is a borehole 205 with depth indicated by 201. The fluid pressure within the borehole is indicated by the line 211. Also shown in FIG. 4 are a plurality of depths 207*a*, 207*b* . . . 207*n* at which formation pressures are sampled using a device such as that disclosed in Berger or Jones. For illustrative purposes, the formation 221 is shown as comprising a shale 223*a* at the top and bottom 223*e* with a reservoir interval including a gas zone 223*b*, an oil zone 223*c*, and a water zone 223*d*. Also shown are pressure measurements that would be made by a FPT-WD device of any of the types discussed above. As can be seen, the vertical pressure gradient 211 in the gas zone is less than the pressure gradient 213 in the water zone which, in turn, is less than the pressure gradient in the water zone 215 for reasons related to differences in density of the formation fluid. It should also be clear from FIG. 4 to those versed in the art why pressure measurements within the borehole itself are not indicative of fluid contacts within the formation: the pressure gradient within the borehole is substantially the hydrostatic gradient of a column of fluid above the measuring device.

Figure 1:
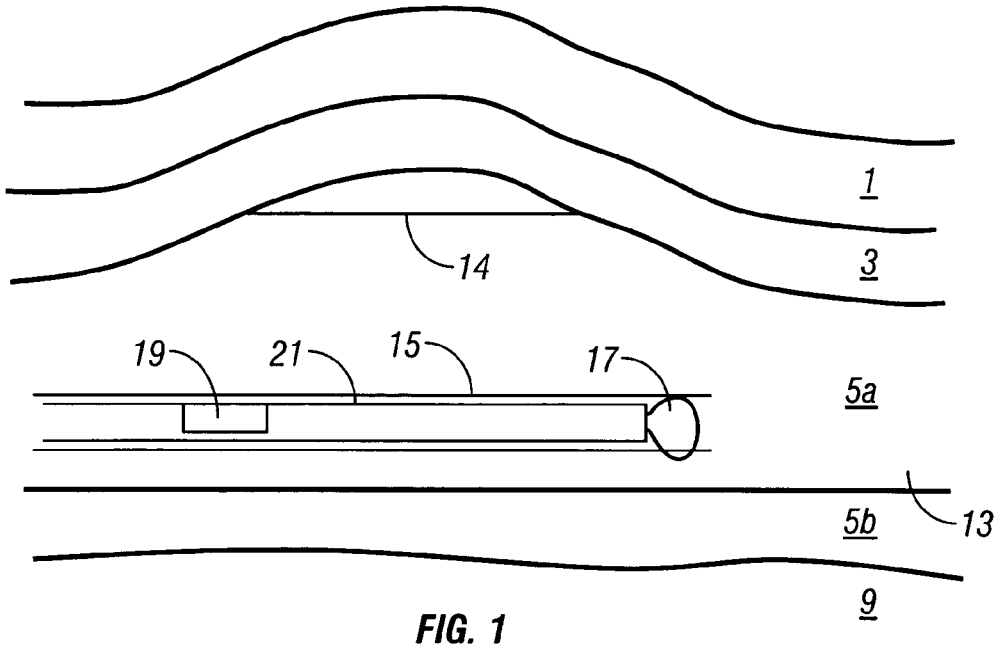
FIG. 1 is an illustration of a substantially horizontal borehole proximate to an oil/water contact in a reservoir.

Formation fluid pressure measurements are thus indicative of distance from the fluid contact. Many methods may be used to establish a reference fluid pressure 219 associated with a particular value of distance 217 above the oil-water contact. The first method is to drill a reference (pilot or vertical) hole into the formation and establish the pressures using pressure measurements in such a reference borehole. This distance may be obtained by actually drilling to the contact. Alternatively, the distance may be measured by using resistivity measurements without actually drilling to the contact. Once this pressure is determined, a deviated hole such as that denoted by 15 in FIG. 1 may be drilled, the formation pressure being measured at suitable intervals using a FPT-WD device until the pressure reaches the reference value. Once this depth has been reached, drilling is continued with pressure measurements being made thereafter. Any deviation of the measured pressure from the reference pressure is then used to provide a correction to the drilling assembly. This is different from the method described by Edwards wherein drilling is continued at the same depth: due to hydrodynamic effects, it is not necessary that the oil-water contact be horizontal over the entire reservoir. In addition, in a complex reservoir, there may be multiple oil-water contacts in different zones and maintaining the same drilling depth would clearly be undesirable. The latter problem is discussed below. It should be noted that the reference pressure itself may change depending upon the position of the wellbore.

A second method is to use measurements from a propagation or induction resistivity tool on the drilling assembly until the oil-water contact is identified (with pressure measurements being made along the way). At this point, the borehole may be closer than desired to the oil-water contact; if so, the depth of the borehole is decreased until pressure measurements indicate that the desired distance from the oil-water contact has been reached. Subsequent drilling is continued with the formation fluid pressure being monitored to maintain the drilling depth.

A particular advantage of the FPT-WD device of Jones et al is the ability to make permeability measurements. Using these permeability measurements, the pressure measurements may be corrected for capillary pressure using known methods to give a more accurate determination of the formation fluid pressure. In addition, if pressure measurements are taken at a plurality of azimuthal directions around the borehole, addition information is obtained about the capillary pressure.

The FPT-WD devices used in the present invention have a precision of 1 psi (0.07 bar). While the accuracy of the pressure measurements is likely to worse, for the present invention, the precision is what counts for maintaining a fixed relative distance to an oil-water contact. The precision of 0.07 bar should make it possible to maintain drilling depth with a high level of accuracy.

Objective 3: Maintaining a Drilling Depth Below Gas Cap

Figure 2:
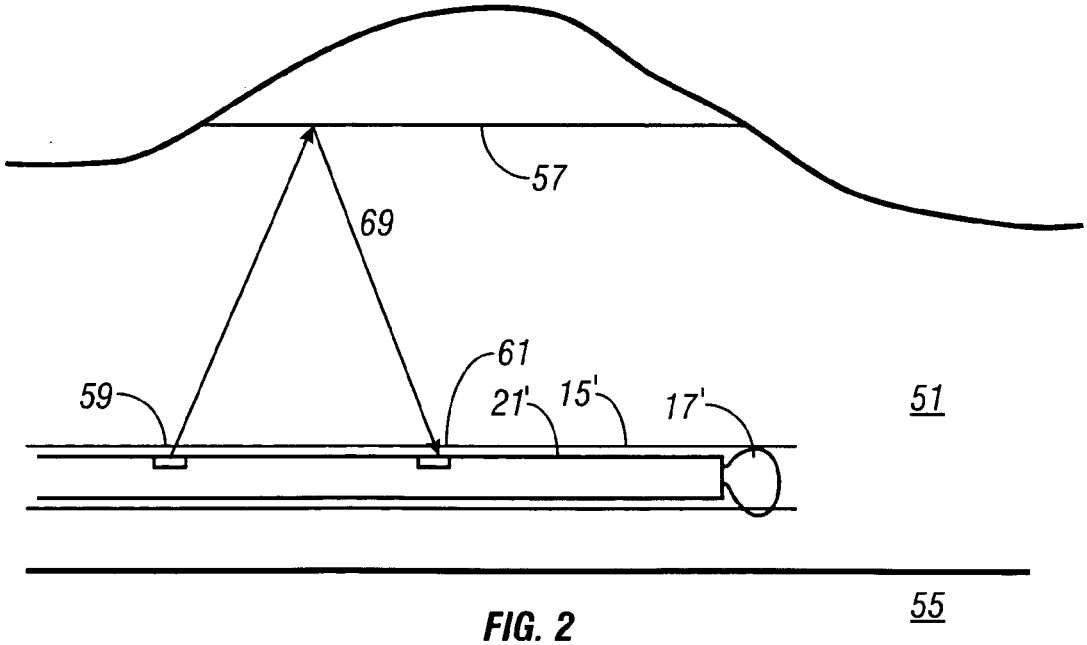
FIG. 2 is an illustration of a substantially horizontal borehole proximate to a gas/oil contact in a reservoir.

This particular problem has been discussed above with reference to FIG. 2. Due to the relatively small difference in resistivity between oil and gas saturated formations, resistivity measurements are not particularly useful for maintaining a desired distance from a gas cap. However, there is a significant difference in the acoustic impedance of a gas saturated formation relative to an oil- or water-saturated formation. Determination of the distance from the borehole to the gas-oil interface may be determined using, for example, the method and apparatus disclosed in U.S. Pat. Nos. 6,088,294 and 6,084,826 ro Leggett et al and Leggett respectively, having the same assignee as the present invention and the contents of which are fully incorporated herein by reference. These are referred to hereafter as the Leggett '294 and the Leggett '826 patents. Specifically referring to FIG. 2, the acoustic velocity of the formation is first determined using one or more acoustic transmitters (denoted by 59) and one or more acoustic receivers (denoted by 61). Once the acoustic velocity has been determined, measured traveltimes for acoustic signals that are generated by the transmitter 59, reflected by the gas-oil interface, and received by the receiver 61 are used to determine a distance and orientation of the gas-water interface relative to the borehole. One exemplary reflected ray is shown in FIG. 2. It is to be noted that the two Leggett patents use the term "bed-boundary) with reference to a reflecting interface, but the method described therein is equally applicable to any reflecting interface such as a gas-oil interface.

Objective 4: Avoid or Escape from a Shale Lens

Figure 5:
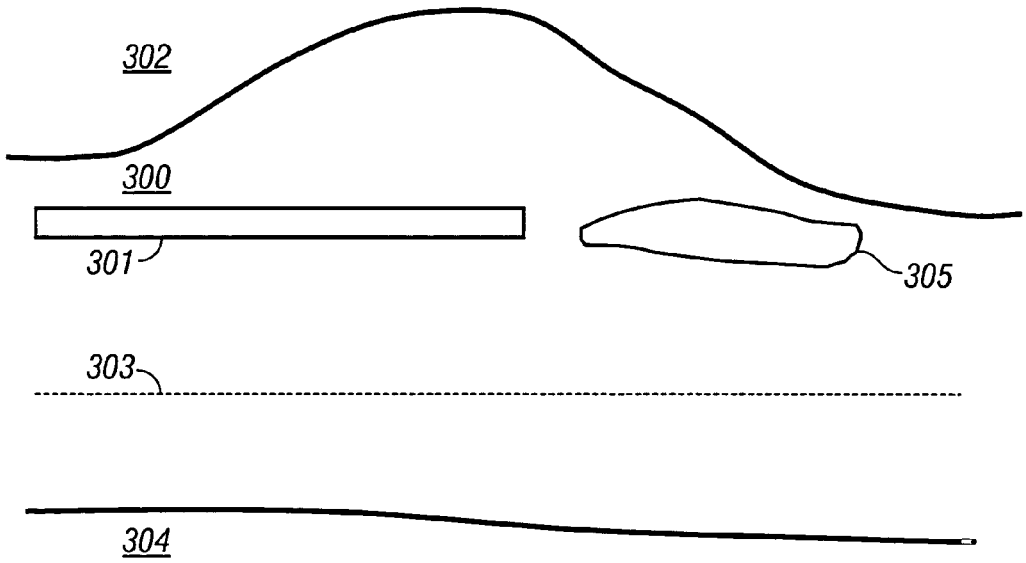
FIG. 5 illustrates the problem of avoiding a shale lens in horizontal drilling, FIG. 6 gives an example of a porosity or gamma ray log in proximity to a shale lens.
Figure 6:
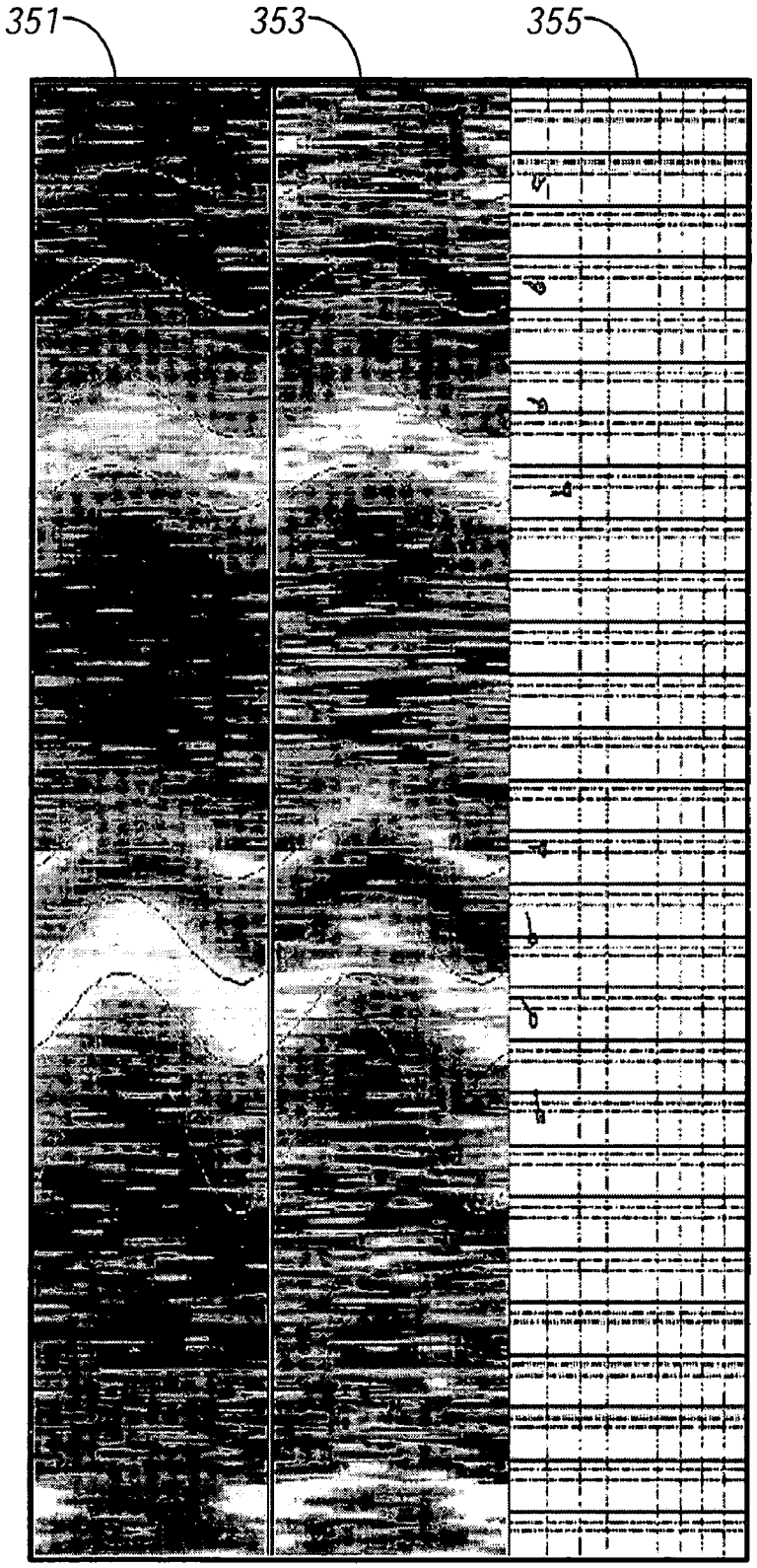

Referring now to FIG. 5, an example is shown of a drilling assembly 301 in a borehole (not shown) in an earth formation 300. Using the method described above, the borehole is being drilled above a oil-water contact 301. Also shown is the caprock 302 and ab exemplary shale lens 305 within the earth formation 300. Such shale lenses occur not infrequently in earth formations and if a borehole is drilled through such a shale lens, the portion of the borehole within the shale lens is non-productive and substantially useless due to the low permeability of the shale. In such a situation, an azimuthal neutron porosity or an azimuthal gamma ray logging device on the drilling assembly may be used to avoid the shale lens. Examples of such azimuthal gamma ray and and density logging devices would be known to those versed in the art. They typically have a depth of penetration of 7–20 cm into the formation surrounding a borehole. An example of a display from an azimuthal gamma ray or porosity tool is shown in FIG. 6. The displays 351 and 353 show an exemplary displays with two different filters, while 353 is an interpreted plot of formation dips. The images 351 and 353 both show differences between the two halves of the images. This is indicative of proximity to a shale lens. Appropriate corrective action can thus be taken.

As an alternative to a gamma ray or porosity logging tool, measurements made with an azimuthal resistivity tool (depth of investigation 1–3 m) or an azimuthal resistivity imaging tool (depth of investigation 3–10 cm) may be used. Qualitatively, they give displays that are similar to the example shown in FIG. 6 in the proximity of a shale lens.

Objective 5: Seismic Tie in and Look-Ahead

Another objective that can be accomplished using the present invention as additional wells are drilled in a reservoir is improving the knowledge of the geophysical structure of the subsurface and using this additional knowledge for looking ahead of the drillbit. As additional wells are drilled, seismic receivers and or transmitters may be installed permanently in the drilled boreholes. Various combinations of seismic sources at the surface, seismic sources and receivers on the drilling tool may be used in conjunction with permanently installed receivers in boreholes to improve the geophysical model of the subsurface. Such methods are described in U.S. Pat. Nos. 6,065,538, 6,209,640, 6,253,848 and 6,302,204 to Reimers et al, having the same assignee as the present invention and the contents of which are fully incorporated herein by reference.

The use of acoustic sources and transmitters on a bottom hole assembly provides additional refinements to the method disclosed in the Reimers patents. When used in conjunction with the bed boundary imaging capabilities of Leggett '826 and Leggett '294, it is possible to map the fault configuration of complex reservoirs since in most instances the faults will act as acoustic reflectors. This objective does not necessarily require the use of the FPTWD measurements. In addition, Vertical Seismic Profiles (VSPs) or reverse VSPs may be obtained: in the former, seismic sources are located at the surface and data are measured downhole, whereas in the latter, surface receivers measure signals from downhole sources. VSPs are obtainable using a receiver on the BHA with sources outside the borehole being drilled, while reverse VSPs are obtainable using a downhole source and receivers outside the borehole being drilled.

Particular types of bed boundaries that are of interest in horizontal drilling include hard calcite streaks and intrusives, both of which will give a strong acoustic reflection and can be imaged using the method of the present invention.

Objective 6: Keeping Wells a Constant Distance Apart

Figure 7:
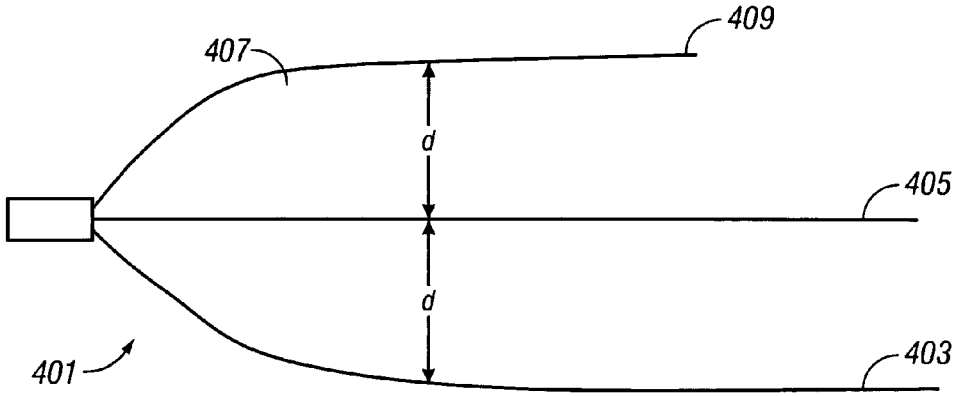
FIG. 7 shows a desired configuration of boreholes for field development.

As noted above, in many instances it is desirable to drill a plurality of boreholes at a specified spacing for optimum field development in addition to the requirement of maintaining a specified distance from an fluid interface. This is illustrated schematically in the plan view of FIG. 7. Shown is a drilling platform 401 in which a first and second well 403, 405 have been drilled and a third well 407 is being drilled with the position of the drilling assembly being indicated by 409. There are a number of approaches that may be used to determine the offset between the borehole 407 and the borehole 405.

Figure 8:
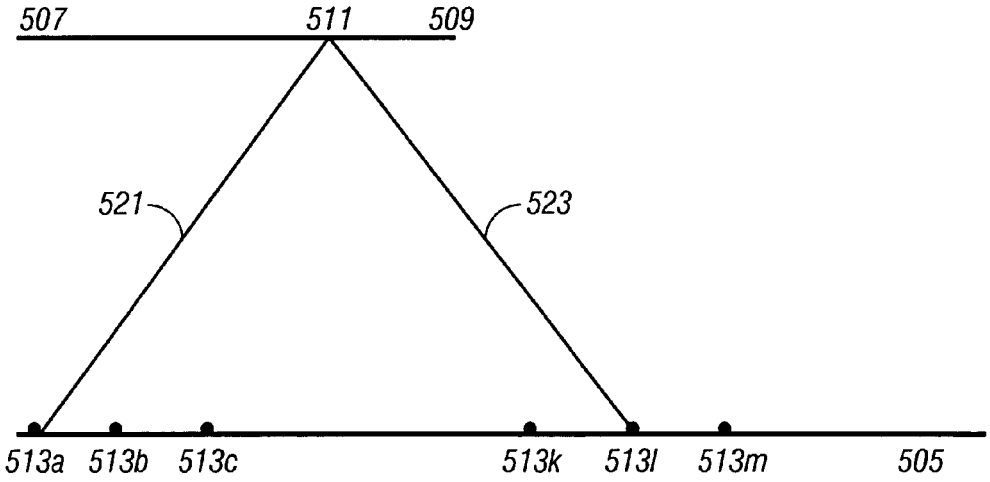
FIG. 8 shows an example of deployment of sensors in a pre-existing borehole in conjunction with a method for determining the location of a new borehole.

Turning now to FIG. 8, the method is described in more detail. After the first borehole 503 has been drilled, a plurality of acoustic receivers denoted by 513*a*, 513*b* . . . 513*m* are installed in the borehole 503. An acoustic transmitter 511 on the drilling assembly 509 in the borehole 507 sends acoustic signals that are received in the acoustic receivers 513*a*, 513*b* . . . 513*m*. There are several problems in determining the distance from the transmitter 511 to any of the receivers using measured travel times between the transmitter and the receiver. One problem is that of determining the acoustic velocity of the medium between the transmitter and the receiver. In the particular case being addressed here, if the reservoir is reasonably homogenous, then measurements of acoustic velocity made using the device of Leggett can be used to determine the acoustic velocity, at the borehole 507. This velocity may then be used as the velocity for the region between the boreholes 503 and 507. Alternatively, the velocity determined at borehole 507 may be averaged with a previously determined velocity in borehole 507. Suitable interpolation schemes may be used if there is a spatial variation in velocity.

A more serious problem is that in order to measure travel times accurately, there must be accurate synchronization between the clock of the transmitter 511 and the clock of the receivers. With a typical acoustic velocity of 3 km/s for the formation, an error of 2 ms in the clocks will give a distance error of 6 m. Maintaining an accuracy of 2 ms is difficult in view of the widely varying temperatures to which a clock on a drilling assembly is subjected.

In one embodiment of the invention, three component geophones are used as the acoustic sensors. Using a method of hodographic analysis described in U.S. Pat. No. 5,170,377 to Manzur et al, having the same assignee as the present application and the contents of which are fully incorporated herein by reference, it is possible to determine a direction of arrival for a raypath such as 521 from the acoustic transmitter 511 to the receiver 513*a*. By making additional direction measurements to a second receiver such as 513*k*, the intersection of the two raypaths gives the location of the transmitter. Using measurements from additional rays to other receivers, a redundant set of measurements may be obtained that compensates for measurements errors. Additionally, if the velocity field between the wells 405' and 407' is known, the calculations can even account for ray bending.

In the method described by Manzur, three component geophones are necessary since the transmitter and the receiver are at different depths. For the present invention, wherein accurate depth control is maintained between the two boreholes using pressure measurements, it is sufficient to have two-component geophones that are responsive to motion in a horizontal plane.

An alternate method for determination of the direction of arrival of raypaths uses proximate pairs of single component geophones. Using a combination of, for example, 513*a* and 513*b*, knowing the acoustic velocity in the formation and the spacing between the two geophones, it is possible to determine a direction of arrival. Such a determined direction will have an ambiguity between the left and right sides relative to a straight line joining the two receivers; this ambiguity is unimportant in the present case since the relative direction is known. Repeating the procedure with another matched pair of receivers such as 513*k*, 513*l* then makes it possible to determine the location of the transmitter.

In yet another embodiment of the invention, the transmitter 511 can be eliminated and the drillbit itself is used as a seismic source. The methods described above with either at least two two-component detectors or with at least two pairs of single component detectors would give the position of the drillbit.

In an alternate embodiment of the invention, pressure pulses are generated in preexisting boreholes, for example, by opening or closing valves between the reservoir and the interior of the preexisting boreholes, the positions of the valves being known. These pulsed pressure variations are detected by the FPTWD device in the BHA of the borehole being drilled. From the times at which these pressure pulses are detected, the distance from the borehole being drilled and the preexisting boreholes can be determined. When the pressure pulses are generated from only one preexisting borehole, the velocity of propagation of the pulses must be known in order to determine a distance from the preexisting borehole. When pressure pulses are generated in two preexisting boreholes, the position of the borehole being drilled can be determined from two traveltime measurements without knowledge of the velocity of propagation and by assuming lateral homogeneity of the reservoir and uniform velocities of propagation of the pulses.

Objective 7: Analysis of Complex Reservoirs

Another objective that can be addressed by the method of the present invention is analysis of a complex mature reservoir having multiple target zones. If these multiple target zones comprise of distinct reservoirs, possible separated by faults, the individual reservoir zones may or may not be in communication with other parts of the reservoir that have already been produced. Measuring the formation pressure when such a zone is penetrated will immediately reveal if this zone has communication with another produced zone. If virgin formation pressure is measured, the zone forms a separate reservoir. If the formation pressure shows that this part of the reservoir is depleted, the zone may remain uncompleted and/or the well may be steered to another sone of interest.

The invention has been described above with reference to a drilling assembly conveyed on a drillstring. However, the method and apparatus of the invention may also be used with a drilling assembly conveyed on coiled tubing.

The foregoing description is directed to particular embodiments of the present invention for the purpose of illustration and explanation it will be apparent, however, to one skilled in the art that many modifications and changes to the embodiments set forth above are possible without departing from the scope and the spirit of the invention. It is intended that the following claims be interpreted to embrace all such modifications and changes.

We claim:

1. A method of developing a hydrocarbon reservoir in an earth formation, the method comprising:

(a) using a bottom hole assembly (BHA) having a drillbit thereon for drilling a borehole, said BHA including a formation pressure tester while drilling (FPTWD) for determining a pressure of a fluid in said earth formation;

(b) drilling said borehole to a first depth;

(c) making measurements of said fluid pressure with said FPTWD during drilling of the borehole; and (d) altering a drilling direction of said borehole if a measured value of said fluid pressure differs from a predetermined value.

2. The method of claim 1 wherein said FPTWD comprises a minimum volume device.

3. The method of claim 1 wherein said predetermined value of fluid pressure corresponds to a specified distance above an oil-water contact.

4. The method of claim 1 wherein said predetermined value of fluid pressure corresponds to a specified distance below a gas-water contact.

5. The method of claim 1 wherein said predetermined value of fluid pressure corresponds to a specified distance below an oil-gas contact.

6. The method of claim 1 further comprising obtaining said predetermined value of said fluid pressure from a vertical borehole in said cart formation.

7. The method of claim 1 further comprising:

(i) making measurements with a resistivity device on the BHA and determining therefrom a distance to a fluid contact within said hydrocarbon reservoir, (ii) defining said predetermined value of said fluid pressure from said determined distance.

8. The method of claim 7 wherein said measurements with said resistivity device are made substantially contemporaneously with said pressure measurements.

9. The method of claim 7 wherein said fluid contact further comprises an oil-water contact.

10. The method of claim 7 wherein said resistivity device is selected from the group consisting of (A) a propagation resistivity device, and, (B) an induction resistivity device.

11. The method of claim 1 further comprising:

(i) making measurements with an acoustic device on the BHA and determining therefrom a distance to a fluid contact within said hydrocarbon reservoir, (ii) defining said predetermined value of said fluid pressure from said determined distance.

12. The method of claim 11 wherein said measurements with said acoustic device are made substantially contemporaneously with said pressure measurements.

13. The method of claim 11 wherein said fluid contact further comprises one of:

(A) a gas-oil contact, and (B) a gas-water contact.

14. The method of claim 1 further comprising using said acoustic device for determining a distance to one of (A) a calcite streak, and, (B) a fault within said earth formation.

15. The method of claim 1 wherein said BHA further includes at least one additional sensor selected from: (i) a gamma my density sensor, (ii) a neutron porosity sensor, (iii) a resistivity imaging sensor, (iv) a natural gamma ray sensor, and, (v) a gamma ray based density sensor, the method further comprising:

using measurements from the at least one additional sensor for altering a drilling direction to avoid a shale lens.

16. The method of claim 1 further comprising:

(i) using an acoustic transmitter on the BHA for generating acoustic waves into said reservoir, (ii) using a plurality of acoustic receivers in a preexisting borehole for making measurements of said generated acoustic waves, (iii) determining a distance between said borehole and said preexisting borehole, and (iv) altering a drilling direction of said borehole so as to maintain a specified relation to said preexisting borehole.

17. The method of claim 16 wherein said plurality of acoustic receivers comprise multi-component geophones, and determining said distance further comprises performing a hodographic analysis of measurements made with said multi-component geophones.

18. The method of claim 16 wherein said plurality of acoustic receivers further comprises two pairs of acoustic receivers, and determining said distance further comprises using a velocity of propagation of said acoustic waves and traveltime differences between receivers within each of said two pairs of acoustic receivers.

19. The method of claim 1 further comprising:

(i) producing pressure pulses in a preexisting borehole in said reservoir at specified times, (ii) measuring an arrival time of said pressure pulses in said borehole using said FPTWD device and determining therefrom a distance from said preexisting borehole to said borehole, and (iii) altering a drilling direction of said borehole so as to maintain a specified relation to said preexisting borehole.

20. The method of claim 1 further comprising;

(i) producing first and second pressure pulses in a first and second preexisting borehole, (ii) determining first and second arrival times for said first and second pressure pulses in said borehole, and (iii) altering a drilling direction of said borehole so as to maintain a specified relation to said first and second preexisting boreholes.

21. A system for developing a hydrocarbon reservoir in an earth formation, the system comprising:

(a) a bottom hole assembly (BHA) having a drillbit thereon for drilling a borehole, (b) a formation pressure tester while drilling (FPTWD) on the BHA for determining a pressure of a fluid in said earth formation, said FPTWD making measurements of said fluid pressure during drilling, (c) a processor for controlling drilling operations to maintain the BHA at a depth wherein a pressure measurement made by said FPTWD is substantially at a specified value.

22. The system of claim 21 wherein said FPTWD comprises a minimum volume device.

23. The system of claim 21 further comprising:

a resistivity device on the BHA for making resistivity measurements and wherein said processor determines from said resistivity measurements a distance to a fluid contact within said hydrocarbon reservoir.

24. The system of claim 23 wherein said resistivity device is selected from the group consisting of (A) a propagation resistivity device, and, (B) an induction resistivity device.

25. The system of claim 21 further comprising:

(i) an acoustic device on the BHA for making acoustic measurements indicative of a distance to a fluid contact within said hydrocarbon reservoir.

26. The system of claim 25 wherein said fluid contact further comprises one of:

(A) a gas-oil contact, and (B) a gas-water contact.

27. The system of claim 21 wherein said BHA further comprises at least one additional sensor selected from: (A) a gamma ray density sensor, (B) a neutron porosity sensor, (C) a resistivity imaging sensor, and, (D) a natural gamma ray sensor.

28. The system of claim 21 further comprising:

(i) an acoustic transmitter on the BHA for generating acoustic waves into said reservoir, (ii) a plurality of acoustic receivers in a preexisting borehole for making measurements of said generated acoustic waves.

29. The system of claim 28 wherein said processor determines from said measurements made by said plurality of acoustic receivers a distance from said preexisting borehole to said borehole.

30. The system of claim 28 wherein said plurality of acoustic receivers comprise multi-component geophones.

31. The system of claim 21 further comprising:

(i) a source for producing pressure pulses in a preexisting borehole in said reservoir at specified times, wherein said processor determines from an arrival time of said pressure pulses a distance from said preexisting borehole to said borehole.

32. The system of claim 21 further comprising:

a first pressure source and a second pressure source for producing pressure pulses from a first and second preexisting borehole respectively;

wherein said processor determines from arrival times of said pulses from said first and second preexisting boreholes a distance of said borehole from said first and second preexisting boreholes.

* * * * *